US005395049A

United States Patent [19]

Huhn

[11] Patent Number: 5,395,049

[45] Date of Patent: Mar. 7, 1995

[54] BOX ENGAGING RETAINER FOR COLLECTORS' CARDS

[76] Inventor: Ray A. Huhn, 2203 44th St., Pennsauken, N.J. 08110

[21] Appl. No.: 186,001

[22] Filed: Jan. 24, 1994

[51] Int. Cl.[6] ..... B65D 5/48; B65D 25/06; B65D 25/10

[52] U.S. Cl. ..... 229/120.02; 206/425; 220/543; 312/183

[58] Field of Search ..... 229/120.02; 220/534, 220/543, 544, 545; 206/425; 312/183, 187, 294, 330.1

[56] References Cited

U.S. PATENT DOCUMENTS

| | | | |
|---|---|---|---|
| 768,735 | 8/1904 | Cordes | 312/187 |
| 960,833 | 6/1910 | Crum | 220/543 |
| 1,500,007 | 7/1924 | Sibbald | 220/543 |
| 2,746,457 | 5/1956 | Musacchia | 220/543 |
| 3,279,642 | 10/1966 | Kafferlin | 220/544 |
| 4,102,470 | 7/1978 | Timmons | 220/543 |
| 4,325,595 | 4/1982 | Solomon | 312/183 |

FOREIGN PATENT DOCUMENTS

| | | | |
|---|---|---|---|
| 64929 | 12/1955 | France | 220/544 |
| 3500543 | 7/1986 | Germany | 312/183 |

*Primary Examiner*—Stephen P. Garbe
*Attorney, Agent, or Firm*—Eckert Seamans Cherin & Mellott

[57] ABSTRACT

A storage arrangement for a stack of collectors' cards includes a box with a front wall, rear wall and laterally spaced sidewalls dimensioned to receive the cards on edge in a stack, one of the sidewalls being open at a top. A filing barrier is attachable at a selected position along the sidewall and has a boundary element for engaging against a face of the cards and a clasp attached to the barrier. The clasp engages over the sidewall, which is, for example cardboard, and permits the box lid to be closed over the box sidewall. The clasp is a resilient clamp attachable to the sidewall. The clasp and barrier element preferably are integral parts of a plastic sheet of uniform thickness, the barrier element being dimensioned approximately the same as a card and the clasp defining a U-shape with opposed legs for bearing against an inner and outer side of the sidewall.

13 Claims, 2 Drawing Sheets

BOX ENGAGING RETAINER FOR COLLECTORS' CARDS

BACKGROUND OF THE INVENTION

1. Field of the Invention

The invention relates to the field of retaining devices for stackable items such as collectors' cards. In particular, the invention concerns a retainer for stacks of cards carried or stored in a cardboard box or the like, wherein the retainer clasps resiliently on one side of the box, to hold a barrier in position for retaining the cards in a stack occupying less than the full length of the box.

2. Prior Art

It is desirable to store cards or sheets in a container on edge in a stack, enabling access to the cards for viewing, filing or removal of particular cards in the stack, etc. Typically, the cards are arranged in a file box in some order (e.g., alphabetical, numerical, by category, etc.), with corresponding sides of the cards facing in the same direction. Extra space can be provided between the stack and any forward or rear barrier of the container, so that a space can be opened between cards. The front or rear face of a selected card in the stack is exposed by this space, and can be viewed. By leaning the front of the stack forward, and leaning individual cards or groups of cards forward, the user can proceed through the stack to find particular cards, to add or remove cards, adjust their order and otherwise to process the stack.

The size of the gap provided between the cards is important. If the gap is too small, the faces of the cards are not adequately exposed to view. If the gap is too large, the stack does not remain upright and the order of the cards may become disturbed. The container size can be selected to provide just enough space in addition to the minimum stack size (in which all the cards rest against one another) to provide an optimal gap that permits viewing while retaining the integrity of the stack. However, this is only workable if no additions or deletions are to be made to the stack. The stack size is generally variable and it is impractical to provide filing containers in various sizes to accommodate different sizes of stacks. The container (or filing enclosure) is selectively sized to have a height and width which are slightly larger than the corresponding height and width of the card or sheet to be contained. The container's depth, however, is selected according to other considerations.

Filing enclosures for cards, files and similar sheets generally involve a box, drawer or similar channel having a lateral width only slightly larger than the cards or sheets, which rest on edge. Identifying information is provided on the faces and/or top edge. When the stack is pulled to the front or rear wall of the box, there is a tendency for the cards to fall over and lay flat. More particularly, the cards on the rear end of the stack remote from the front end at which the cards are retained by the inside front wall, tend to fall over. The cards may fall with the top edge falling away from the stack, or the bottom edge may slide rearwardly away from the stack along the bottom edge. In either case, the result is that the integrity of the stack is compromised. The fallen cards may become displaced under the cards standing on edge, such that the fallen cards (now under the edge-standing stack) are "missing" from the stack. If the cards are again stacked on edge, some may have their back sides facing forward. The integrity of the stack is compromised because not all the cards remain in order, with front faces forward.

It is known in connection with file drawers to provide a movable barrier that rests against the endmost file in a stack of files on edge. The position of the movable barrier is adjusted to permit a gap to be formed between the files sufficient to view the identifying information on the faces of the files. Typically, the movable barrier is locked at any selected point along a rail or track provided along the bottom of the file drawer. Such a barrier is appropriate for permanent structures such as file drawers, but is not practical for more temporary enclosures such as cardboard storage boxes. It is also known in connection with so-called "hanging" files to support the files slidably along movable rails extending longitudinally along both lateral sides of a file drawer. Downwardly opening hooks are provided on support webs for the files and slide along the rails. Whereas the files are thereby supported vertically, they cannot fall over and remain in order. Four such hooks are needed, two for each of the front and rear of each file-receiving web or enclosure. The hooks are not provided on the files themselves.

Solutions that are appropriate for file drawers are generally not appropriate for more temporary enclosures or less expensive enclosures. The present invention seeks to provide an optimal filing arrangement for collectors' cards. The members of sports teams and the like are popularly depicted on individual cards in sets, the sets including, for example, all the players in a particular sports league for a given year, the members of a team, etc. Such cards may be indexed alphabetically, categorized by team, by player position, by statistics, etc. Collectors' cards can be substantial efforts to obtain and maintain complete sets.

A collector stores the cards in boxes having a lateral width only minimally larger than the corresponding dimension of the cards, for example either in height or width. The boxes are generally craft paper boxes, e.g. of corrugated craft. The cards are stacked upright on their bottom edges, or stacked sideways such that the cards lay laterally on their left or right sides. Typically, the box has an attached lid that is hingeable at a fold along one side of the box, or the box may have a completely removable lid that engages over both sides.

It would be advantageous to provide a means for retaining a stack of collectors' cards in order, in an inexpensive and effective arrangement that is generally applicable to cardboard containers and similar arrangements in which the cards routinely are supplied.

SUMMARY OF THE INVENTION

It is an object of the invention to provide a convenient movable retainer for collectors' cards, that engages one sidewall of a cardboard box or the like, for maintaining the integrity of a stack of cards.

It is a further object of the invention to provide a retainer for edge-stacked cards that is sufficiently inexpensive to be appropriate for use as an end barrier or position marker in a stack, and which does not interfere with the lid of the container for the stack.

These and other objects are accomplished by a storage arrangement for a stack of collectors' cards, including a box with a from wall, rear wall and laterally spaced sidewalls dimensioned to receive the cards on edge in a stack, one of the sidewalls being open at a top. A filing barrier is attachable at a selected position along the sidewall and has a boundary element for engaging against a face of the cards and a clasp attached to the barrier. The clasp engages over the sidewall, which is, for example cardboard. The clasp is a resilient clamp attachable to the sidewall. The clasp and barrier element preferably are integral pans of a plastic sheet of uniform thickness, the barrier element being dimensioned approximately the same as a card and the clasp defining a U-shape with opposed legs for bearing against an inner and outer side of the sidewall.

BRIEF DESCRIPTION OF THE DRAWINGS

There are shown in the drawings certain exemplary embodiments of the invention as presently preferred. It should be understood, however, that the invention is capable of variations within the scope of the appended claims. In the drawings.

DETAILED DESCRIPTION OF THE PREFERRED EMBODIMENTS

Figure 1:
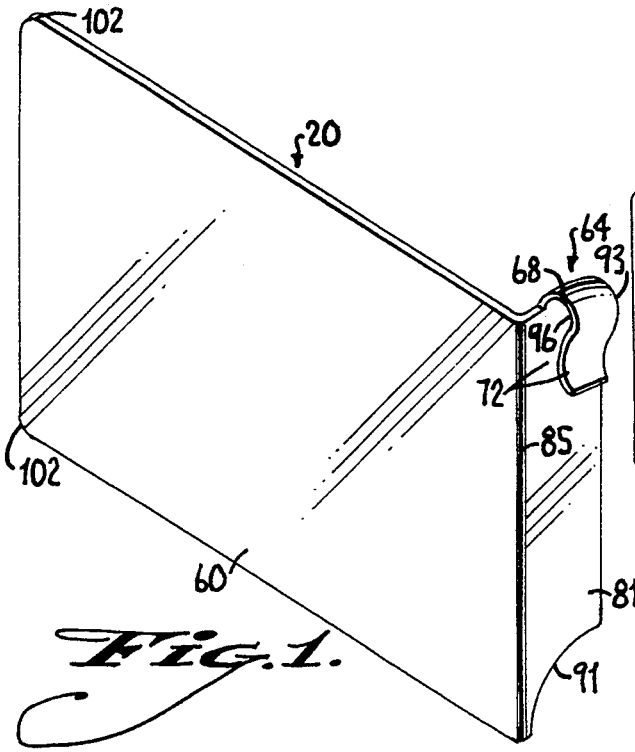
FIG. 1 is a perspective view of a filing barrier according to the invention.
Figure 2:
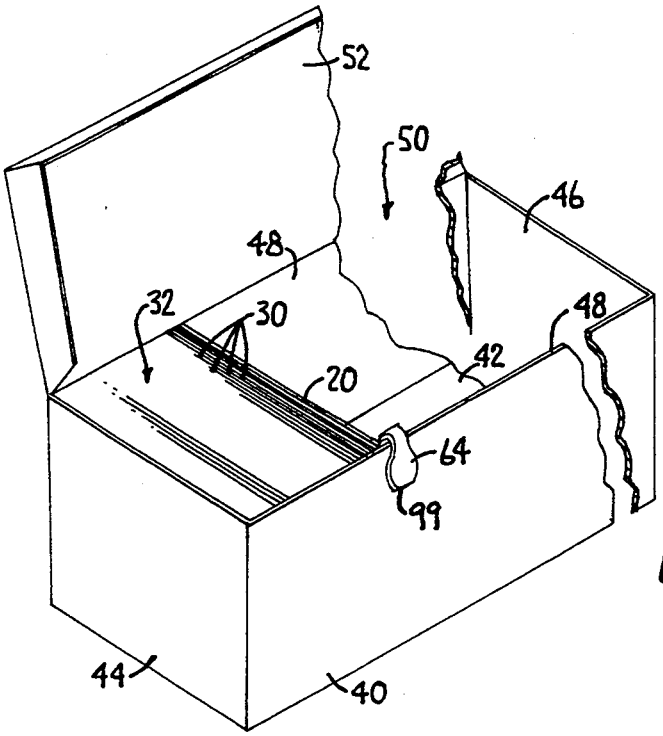
FIG. 2 is perspective view, partly cut away, showing the filing barrier in place for retaining a stack of collector's cards.

A filing barrier 20 according to the invention, for interfiling between one of collectors' cards 30 (FIG. 2), comic books (not shown), and the like, is shown separately in FIG. 1, and in position for use in FIG. 2. Throughout the drawings the same reference numbers are used to identify corresponding elements. The filing barrier 20 holds a position along a stack 32 of sheet materials such as collectors' cards 30 (FIG. 2) or comic books (not shown), stored on edge in a container 40 and confined by the container 40 by the container's bottom 42 and four sides 44, 46, 48. The container 40 thus has a length between a front wall 44 and a rear wall 46, and laterally spaced sidewalls 48, defining an open top 50 that preferably receives a lid 52. The filing barrier 20 includes a boundary element 60 for engaging against a face of the sheet materials in the container 40, and a clasp 64 attached to the barrier or boundary element 60. The clasp 64 engages over one of the sidewalls 48 at the top 50, for fixing the position of the filing barrier 20 at any selected position along the length between the front and rear walls 44, 46 of the container 40.

The boundary element 60 of the filing barrier 20 extends substantially between the sidewalls 48, and is approximately the same height and width as the sheets, e.g., the collectors' cards 30, which are about three by two inches (5×7.5 cm). Collectors' cards 30 typically have a picture on the front face and statistical information on the rear (not shown). The information may be oriented in portrait mode or in landscape mode. Portrait mode cards may be stacked either on a side edge, as in the container 40 (e.g., FIG. 2), or upright in such a container as is suitably sized for upright cards, comic books or the like (not shown, but the embodiments of the barrier as shown in FIGS. 4 and 5 are suitable for interfiling between upright cards, comic books, and the like).

Figure 3:
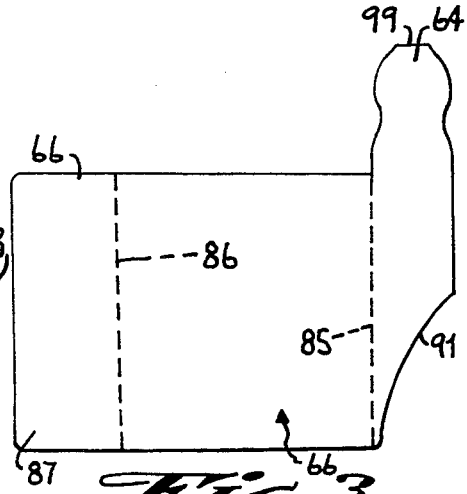
FIG. 3 is an elevation view showing a first embodiment of the filing barrier prior to bending.
Figure 4:
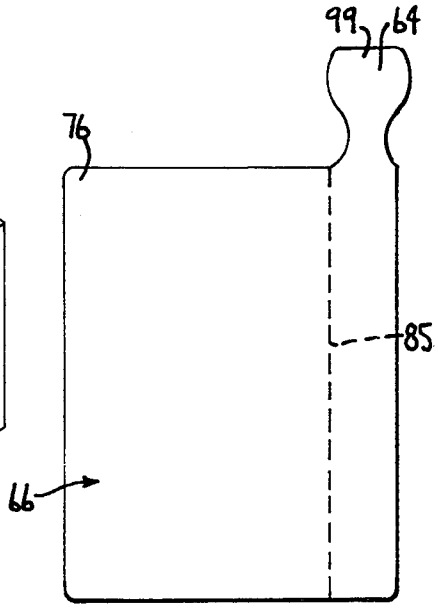
FIG. 4 is an elevation view showing a second embodiment of the filing barrier prior to bending.
Figure 5:
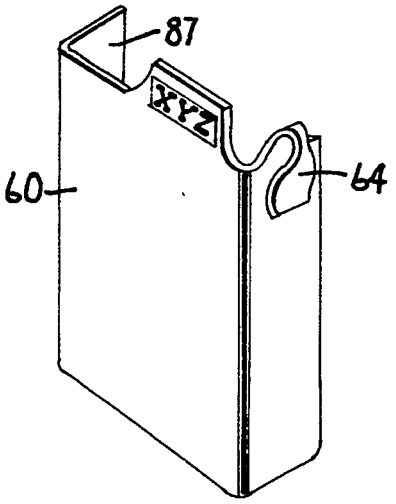
FIG. 5 is a perspective view showing an alternative embodiment dimensioned for upright collector's cards.

Preferably, the barrier element 60 and the clasp 64 are integral, and are formed from a sheet 66 of uniform thickness, which can be shaped as shown in FIG. 3 or FIG. 4. The preferred material is polycarbonate plastic containing no polyvinyl chloride (PVC), and is about one sixteenth inch (1.6 mm) in thickness. Polycarbonate is clear, and affords a view of the adjacent collector card when the filing barrier 20 is placed at the end of a stack of cards 30. Of course, the filing barrier 20 can also be placed at any selected intermediate position along the stack, for marking a position or for separating the stack into categories of one type or another. Polycarbonate is also smooth, and tends to avoid frictional damage to the cards 30 when the barrier 60 and/or the facing card are moved relative to one another. The barrier element 20 as a whole, or the boundary-defining portion 60 or clasp 64 also can be translucent or opaque and can be made of metal or another material. The boundary element 60 and/or the clasp 64 can bear identifying information such as text (not shown) relating to the collectors' cards 30, or can be distinctively colored to assist in defining different categories.

In FIG. 3, the boundary element can be formed from sheet 66 for cards stacked on their sides (i.e., for landscape oriented cards). In FIGS. 4 and 5, the boundary element can be formed from sheet 66 for cards stacked upright (i.e., for portrait oriented cards). The flat outline 76 of the boundary element of FIGS. 4 and 5 can be tall enough for portrait cards and extend to the bottom 42 of container 40. As shown by FIG. 3 vs FIGS. 4 and 5, the bottom edge of the barrier formed under the clasp 64 upon bending along line 85 may extend to the bottom of the container or stop short of the bottom.

Figure 6:
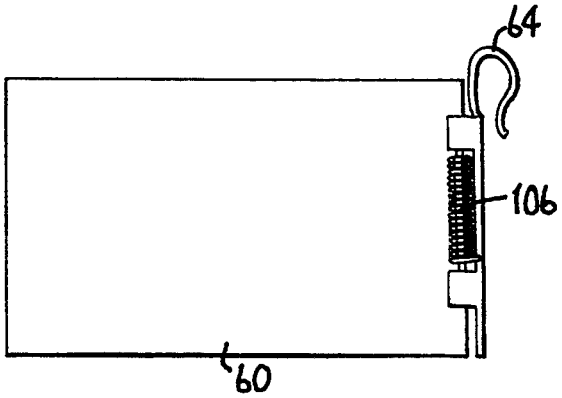
FIG. 6 is a partial end view showing the details of the clasp.
Figure 7:
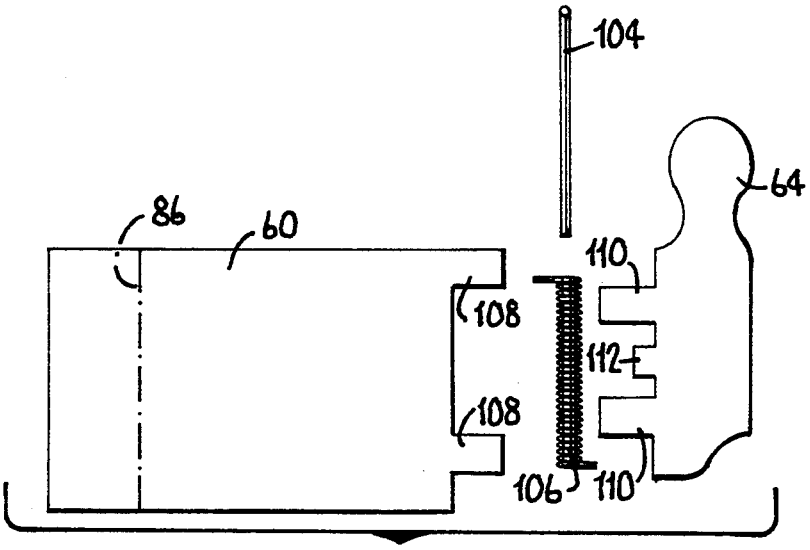
Figure 8:
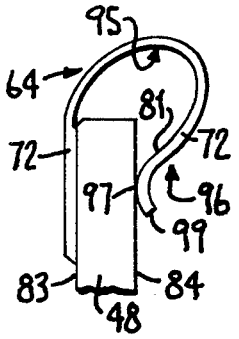

The clasp 64 attached to the barrier 60 engages over one of the sidewalls 48 of the box 40 at the top 50, as shown in FIG. 2, for selectively fixing the position of the barrier 60 between the front and rear walls 44, 46. For this purpose the clasp 64 defines a resilient clamp having a U-shape 68 with opposed legs 72 closing to slightly narrower than the width of the container wall 48, the legs 72 bearing respectively against the inner face 83 and outer face 84 of the container wall 48. For example, for a craft cardboard box of about three sixteenths inch wall thickness (4.5 mm), the clasp can narrow to one eighth inch (3 mm) at rest. The clasp is tight enough to frictionally attach the filing barrier 20 to the sidewall 48 until manually repositioned by being lifted out and placed at another point, or by being slid further to the front or rear of the container 40. FIG. 6 illustrates the clasp in detail.

In the embodiments shown in FIGS. 1 and 5, the clasp 64 and the barrier or boundary element 60 are formed in one of several ways known in the art. For example, the barrier or boundary element 60 may be formed by injection molding. Additionally, the barrier or boundary element 60 may be formed by heating selected portions of the plastic sheet 66, forming the boundary 60 and clasp portions 64 to the required shape, and allowing the plastic to cool to fix them in position. FIGS. 3 and 4 show preferred outlines of the flat sheet 66 prior to bending. The sheet includes the boundary element portion 60, which is rectilinear and preferably approximately the same size as the cards 30. The clasp element 64 includes an inner wall portion 81 that is bent perpendicular to the plane of the boundary element 60 along line 85. Along the bottom edge, the clasp element 64 can attach to the boundary element 60 along a taper 91 as shown in FIG. 3, which allows the barrier element 60 to lean forward or rearward somewhat, if desired. Alternatively, this bottom edge 91 can form a right angle as shown in FIG. 4, which tends to hold the barrier element 60 upright closely spaced above or actually abutting the bottom 42 of the box or other container 40.

Extending from the top of the inner wall portion 81 is a bent-over tab 93 that, with the inner wall portion 81, defines the resilient clasp 64. The tab 93 is bent over in an arc 95 having an internal diameter that is slightly greater than the thickness of the container wall 48, leading into a distal S-shaped bend 96 (see FIGS. 1 and 6). Thus the tab 93 has a minimum clasping dimension at a nip 97, and when clasped over the container wall 48, the distal end 99 of the tab resides slightly above the outer face 84 of the container wall 48, allowing finger access for manipulating the barrier element 20. The distal end 99, as well as the three free comers 102 of the boundary element 60, can be rounded to reduce sharp edges that might mar a collectors' card 30 in the stack.

Preferably, the sheet 66 forming the boundary element 60 and the clasp 64 are integral parts of a plastic sheet of uniform thickness. It would also be possible to provide different thicknesses for the boundary element 60 and the clasp 64. Additionally, it would be possible to assemble the boundary element 60 and the clasp 64 from two or more different parts. The clasp 64 needs to have a thickness sufficient for strength, but is arranged to reside close to the outer face 84 of the container wall 48 so that the container lid 52 can be passed over the filing barrier 20 when in place. Preferably, the tab 99 resides about one eighth inch (3 mm) beyond the outer surface 84 of the container wall 48.

The storage arrangement as shown is especially apt for collectors' cards 30. The cards can be individual single cards, cards in protective envelopes or boxes, or groups of cards. The cards can be placed between the filing barrier 20 and the front or rear wall 44, 46 of the container, whereupon the boundary element 20 defines a movable end barrier for the stack, or the barrier 20 can be placed at an intermediate point at which the user wishes to subdivide the stack, e.g., into some arbitrary categories. It is simple to displace the filing barrier 20 along the sidewall 48 of the box 40 to open or close the length between ends of the stack or a subset of the stack, whereupon the cards 30 can be viewed by leaning the successive cards in the stack so as to expose the face of individual cards.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A filing barrier for a stack of materials stored on edge perpendicular to a planar vertical wall having a free edge at a top of said wall, the filing barrier comprising:

a boundary element for protruding into the stack and engaging the stack;

a clasp fixed to the barrier, the clasp defining an opposed U-shape with opposed legs extendable downwardly from the top and bearing resiliently toward one another, whereby the legs are engageable over the top of the wall to bear inwardly around the wall at the top, the clasp forming exclusively a mounting attachment for the boundary element, such that a position of the filing barrier along the wall is fixable exclusively by said clasp, and wherein the clasp includes an inner wall portion extending substantially perpendicular to a plane of the boundary element, the inner wall portion forming at least part of an inner one of the U-shaped legs.

2. The filing barrier according to claim 1, wherein the boundary element and the clasp are integral.

3. The filing barrier according to claim 2, wherein the boundary element and the clasp are formed of a sheet of uniform thickness.

4. The filing barrier according to claim 3, wherein the sheet is plastic.

5. The filing barrier according to claim 1, wherein the clasp includes a distal tab defining an S-shaped bend.

6. In combination, a filing barrier and a box, for sheets storable on edge in a stack in the box, comprising:

the box having a front wall, a rear wall and laterally spaced sidewalls defining a container with an open top, for receiving the sheets;

the filing barrier comprising a boundary element for engaging against a face of the sheet materials in the container, and, a clasp attached to the barrier, the clasp engaging over one of the sidewalls at the top, for selectively fixing a position of the barrier between the front and rear wall, the clasp defining a U-shape with opposed legs for bearing resiliently against an inner and outer side of said one of the sidewalls, forming a resilient clamp attachable to said one of the sidewalls, that fixes said position of the barrier.

7. The combination according to claim 6, wherein the boundary element and the clasp are integral parts of a plastic sheet of uniform thickness.

8. The combination according to claim 6, wherein the clasp includes an inner wall portion extending substantially perpendicular to a plane of the boundary element, and a bent-over U-shape for engaging over said one of the container sidewalls.

9. The combination according to claim 8, wherein the clasp includes a distal tab defining an S-shaped bend.

10. A storage arrangement for a stack of cards, comprising:

a box with a front wall, rear wall and laterally spaced sidewalls dimensioned to receive the cards on edge in a stack, said box having an open top;

a filing barrier having a boundary element for engaging against a face of the cards and a clasp attached to the barrier, the clasp engaging over one of the sidewalls at the top of the box for selectively fixing a position of the barrier between the front and rear wall, the clasp defining a U-shape with opposed legs for bearing resiliently against an inner and outer side of said one of the sidewalls, forming a resilient clamp attachable to said one of the sidewalls, that fixes said position of the barrier.

11. The storage arrangement according to claim 10, wherein the boundary element and the clasp are integral parts of a plastic sheet of uniform thickness.

12. The storage arrangement according to claim 10, wherein the clasp includes an inner wall portion extending substantially perpendicular to a plane of the boundary element, and a bent-over U-shape for engaging over said one of the box sidewalls.

13. The storage arrangement according to claim 10, wherein the clasp includes a distal tab defining an S-shaped bend.

* * * * *

UNITED STATES PATENT AND TRADEMARK OFFICE

CERTIFICATE OF CORRECTION

PATENT NO. : 5,395,049

DATED : March 7, 1995

INVENTOR(S) : Ray A. Huhn

It is certified that error appears in the above-indentified patent and that said Letters Patent is hereby corrected as shown below:

Column 2, line 34, after the word "be", insert -- quite valuable, and collectors expend --.

Signed and Sealed this

Thirteenth Day of June, 1995

*Attest:*

Bruce Lehman

BRUCE LEHMAN

*Attesting Officer*

*Commissioner of Patents and Trademarks*